US005834740A

United States Patent [19]

Wilde et al.

[11] Patent Number: 5,834,740

[45] Date of Patent: Nov. 10, 1998

[54] METHOD OF PRODUCING A RADIANT HEATER AND RADIANT HEATER

[75] Inventors: Eugen Wilde, Knittlingen-Freudenstein; Martin Gross, Kaempfelbach, both of Germany

[73] Assignee: E.G.O. Elektro-Gerätebau GmbH, Germany

[21] Appl. No.: 666,668

[22] Filed: Jun. 18, 1996

[30] Foreign Application Priority Data

Jun. 23, 1995 [DE] Germany ..... 195 22 798.0

[51] Int. Cl.[6] ..... H05B 3/68; H05B 3/00

[52] U.S. Cl. ..... 219/464; 29/611

[58] Field of Search ..... 219/464, 465, 219/467, 457, 458, 459, 460, 463; 29/611, 614, 615, 848

[56] References Cited

U.S. PATENT DOCUMENTS

| | | | |
|---|---|---|---|
| 4,161,648 | 7/1979 | Goessler | 219/464 |
| 4,713,527 | 12/1987 | Kcherer et al. | 219/464 |
| 4,789,773 | 12/1988 | Mikschl | 219/464 |
| 4,864,105 | 9/1989 | Morgan et al. | 219/464 |
| 5,048,176 | 9/1991 | Doerner | 29/611 |
| 5,153,413 | 10/1992 | Wilde | 219/463 |
| 5,171,973 | 12/1992 | Higgins | 219/464 |
| 5,181,312 | 1/1993 | Gross | 29/611 |
| 5,453,597 | 9/1995 | McWilliams | 219/467 |
| 5,471,737 | 12/1995 | McWilliams | 29/611 |

FOREIGN PATENT DOCUMENTS

| | | |
|---|---|---|
| 035280 | 3/1981 | European Pat. Off. . |
| 612199 | 2/1994 | European Pat. Off. . |
| 2806367 | 8/1978 | Germany . |
| 2729930 | 1/1979 | Germany . |
| 4331702 | 3/1995 | Germany . |
| 94 19 922 | 2/1996 | Germany . |

*Primary Examiner*—Teresa J. Walberg
*Assistant Examiner*—Sam Paik
*Attorney, Agent, or Firm*—Quarles & Brady

[57] ABSTRACT

For producing a radiant heater it is proposed to produce a flat disk-shaped tablet as a separate thermally insulating molding outside of the carrier dish of the radiant heater. On this, heating conductors in the form of corrugated strips provided with fastening feet are pressed into the flat top surface of the tablet. In conclusion the radiant heater is fitted by insertion of this prefabricated component.

13 Claims, 1 Drawing Sheet

METHOD OF PRODUCING A RADIANT HEATER AND RADIANT HEATER

TECHNICAL FIELD AND BACKGROUND OF THE INVENTION

The invention relates to a method of producing a radiant heater comprising a carrier dish and an insulating layer inserted therein to which a heating conductor is secured, as well to such a radiant heater.

From DE 27 29 930 A a radiant heater unit for vitrified ceramic electric cookers has become known in which one or more insulating layers of non- or weakly-compacted bulk material is/are located in a carrier dish. On these layers a plate of fibrous insulating material is placed on which heating spirals are defined by embedding in the wet condition. The plate is held down by a rim on all sides. In this case, securing the heating conductors is done ideally, however, a two-layer configuration is necessary.

From DE 28 06 367 A a radiant heater has become known in which a bulk-flow insulating material is filled into a carrier dish and compacted by a ram so that a surface forms on which the heating spirals can be securely attached by means of wire clips, whereby the surface need not be flat.

A similar configuration incorporating heating spirals embedded in deep grooves has become known from EP 35 280 B, a lower, thin layer of bulk-flow insulating material being directly pressed into the carrier dish, whilst on top of this a thicker layer of aluminum silicate bound by an anorganic adhesive is provided which is thus able to "tack") the heating conductor.

To ensure reliable location of the insulating layers the face surface of the lower layer or the bottom surface of the upper layer are each curved away from each other.

A multilayer insulation structure is not only complicated but also as regards its insulating effect is inferior to a single-layer structure at least then, when one of the layers consists of not so good thermally insulating material. This is why the intention is to make do possibly with a single layer of best-suitable thermally insulating material, this being a bulk-flow insulating material which is correspondingly compressed to hold it together.

SUMMARY OF THE INVENTION

The object of the invention is to define a method and a radiant heater produced thereby with which satisfactory and uniform embedding of the heating conductor is made possible whilst being simple to produce and with high effectiveness of the insulation.

This object is achieved by a method as set forth in claim 1. Producing the complete insulation of a bulk-flowable thermal insulating material resistant to high temperatures as a prefabricated tablet permits production in a shape accurately dimensioned as to size and shape, it enabling it to be ensured in particularly that after compression of the insulating material the top surface of the tablet is flat. Into this flat top surface the heating conductors, received in grooves in the remaining part of the flat ram, from which they protrude by their fastening feet, can be pressed into place so that each of the feet is pressed into the top surface to a uniform depth and accordingly also the protruding part has consistently the same width when this is intended.

This could not be achieved when pressing the insulating layer directly into the carrier dish. The carrier dish produced as a dish of sheet metal usually had a bottom which is naturally convex. In addition to this, the insulation inherently arched due to a radial compressive stress. When the fastening feet were pressed into this arched top surface either the fastening in the edge portion was incomplete or so deep in the middle portion that the irradiating surface of the heating conductors was insufficient.

Curving the ram head was also not the solution since curving of the thermally insulating layer was unpredictable and irregular and, apart from this, a curved surface carrying the heating conductors would have resulted in the overall height of the radiant heater being prohibitively increased.

In the invention both production of the thermally insulating molding and application of the heating conductors is preferably done in a separate mold outside of the carrier dish and the one-piece tablet, thus prepared, fitted with the heating conductor, is inserted in the vacant sheet-metal plate. In this arrangement a convex bottom of the sheet-metal plate is not at all a disturbance, since this even promotes the existence of an additional air insulating space. The tablet is one-piece and preferably also single-layer, but could also be configured compressed multi-layer.

Safe and steady placement can be assured by rimming the carrier dish with a ring-shaped supporting shoulder standing off from the bottom to support the tablet edge which may be correspondingly offset.

The heating conductors concerned may preferably consist of a thin corrugated strip of heating conductor material which is secured upright to the insulator by it being pressed into place by the fastening feet formed in the strip which protrude spaced away from each other, but which may also, if required, extend over the full length of the heating conductor and/or be interrupted by perforations. These are curved to comply with the corrugation of the strip of the tablet and thus form spade-like fastening elements of safe configuration due to their curvature which may also be impressed into the finished top surface of the tablet.

These and further features are evident not only from the claims but also from the description and the drawings, each of the individual features being achieved solely in itself or in a plurality in the form of subcombinations for one embodiment of the invention and in other areas any may represent advantageous aspects claimable in their own right and for which protection is claimed herein. Sectioning the application and the intermediate headings thereof shall not restrict the statements made thereunder in their validity in general.

BRIEF DESCRIPTION OF THE DRAWINGS

An example embodiment of the invention will now be detained as illustrated in the drawings in which.

DETAILED DESCRIPTION

Figure 1:
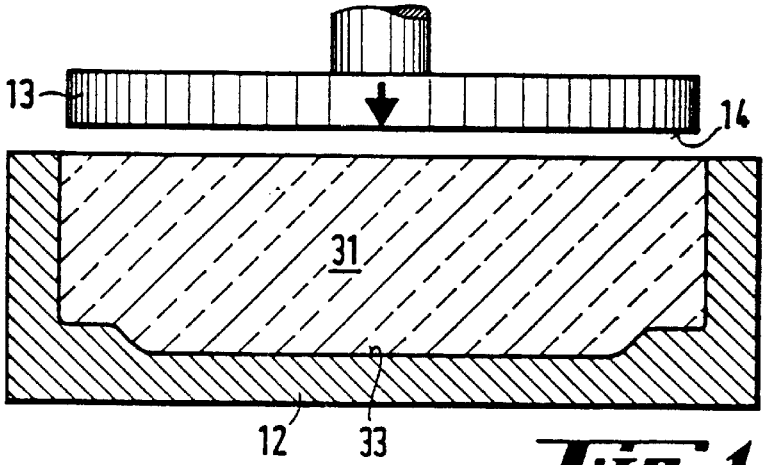
FIG. 1 shows a mold with a ram for a first step in production.
Figure 2:
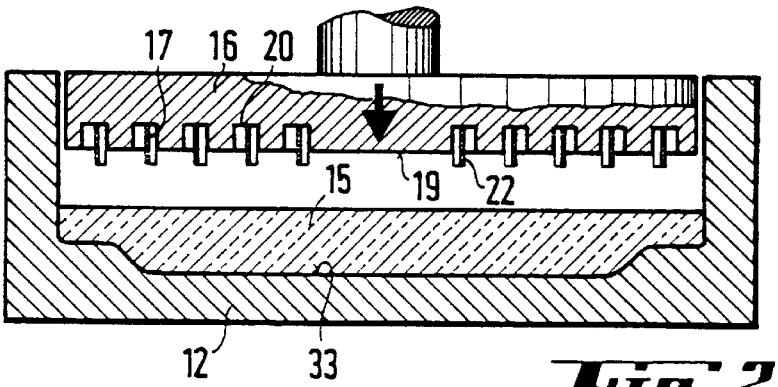
FIG. 2 shows the mold with a ram for a second step in production.
Figure 4:
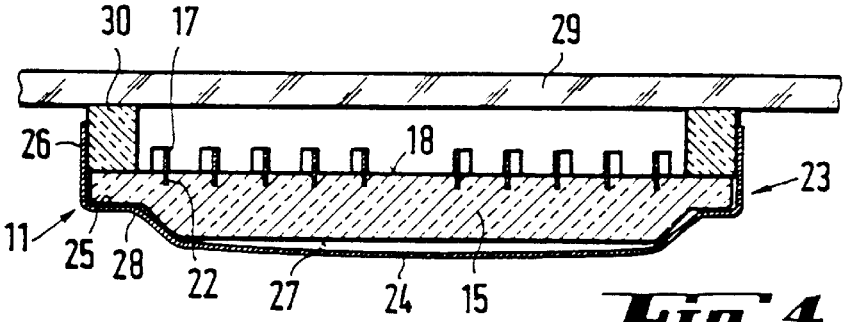

For producing a radiant heater 11 (FIG. 4) a bulk-flowable insulating material 31 is filled into a mold 12 shown in FIGS. 1 and 2 and, where required, swept smooth for even filling. The mold is formed to more or less comply with the outer shaping of the radiant heater, but must not necessarily precisely agree therewith. Instead, the mold cavity 33 may depart from the final shape of the product produced therein so that the product after being compressed, and taking into account all further intermediate steps in production, receives in conclusion the desired final shape.

The insulating material concerned is a silicic acid aergogel which is produced pyrogenically and has a dust-like consistency in the non-compressed condition. This silicic acid aergogel is normally compounded with additives such as clouding agents to reduce radiation transparency, binding agents and/or reinforcing agents to enhance the mechanical strength, for example fibers. It is, however, desirable and an advantage of the invention that the separate thermally insulating molding can be produced free of fibers.

Into the mold a ram 13 can be advanced which compacts the loose bulk material so that a tablet results which can be handled but which is not compacted to the extent that it would lose its good thermally insulating properties. In addition, due to the configuration of the mold cavity it can be ensured by configuring the ram, if needed, in a departure from the flat shape of the ram face 14, that the resulting thermally insulating molding 15, also termed a tablet in the following, has a flat top surface.

In the same mold or, if required, in another supporting mold or on a suitable base surface a heating conductor strip 17 is then partially pressed into place in the top surface 18 of the thermally insulating molding 15 by an insertion ram 16. For this purpose the insertion ram 16 has grooves 20 in its surface facing the top surface 18. These grooves are arranged according to the desired arrangement (macroform) of the heating conductor, for example, in the shape of a spiral or meander, they having roughly the same width as the heating conductors.

Figure 3:
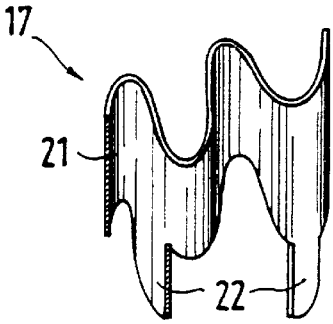
FIG. 3 is a detail illustration of a heating conductor strip section in perspective and FIG. 4 is a schematic illustration of the radiant heater as completed from FIG. 1 and FIG. 2.

In the example illustrated, the heating conductor 17 consists of a thin strip of heating conductor material which is not shown in more detail in FIG. 3. The thickness is mostly in the range of but a few hundredths of a millimeter, e.g. 0.04–0.7 mm, whilst its width amounts to several millimeters. On the lower edge of the full-length strip-like portion 21 fastening feet 22 are arranged which are fabricated integrally with the strip by suitable punching or cutting means. These e.g. rectangularly or trapezoidally defined fastening feet are, like the strip, corrugated so that the strip exhibits a corrugation oriented transversely to its main direction. The axes of curvature of the corrugations thus stand perpendicular to the faces 18, 19.

The heating conductor strips 17 are maintained in the grooves 20 by being correspondingly dimensioned and by spring contact or by magnets incorporated in the insertion ram so that the fastening feet 22 protrude from the grooves 20 past the face surface 19 of the insertion ram 16. Accordingly, the insertion ram is pressed against the flat top surface 18 of the tablet 15 i.e. just sufficiently so that the fastening feet 22 penetrate into the precompressed material. The face 19 of the insertion ram limits the movement of the ram, which however can be captured accordingly by a control means. In this respect a certain after-compression may be provided which, however, is not a mandatory requirement. The ram 16 is then rectracted whilst the heating conductors 17 remain on the tablet 15. This may be facilitated by e.g. switching off an electric magnet holding the heating conductors.

After this the thermally insulating molding 15 now permanently connected to the heating conductor strip is removed from the mold or its fixture and may, where necessary following buffer storage, be inserted as a prefabricated item into a sheet-metal carrier dish 23 of a radiant heater. This sheet-metal carrier dish has the shape of a shallow dish having, slightly elevated with respect to the bottom 24, a rim 25 with which the vertically projecting outer edge 26 comes into contact. The tablet 15 has a bottom shaped accordingly to this configuration, namely a recessed bottom section 27 and an edge portion 28 which as compared to the latter is offset upwards and which comes to rest on the supporting shoulder 25 on insertion of the tablet 15.

Although as regards the thermally insulating molding it would be possible to mold an upswept rim subsequently at the flat top surface 18 in the outer portion thereof which insulates the outer edge 26 of the sheet-metal carrier dish 23 on the inside, it is preferred to insert a separate ring-shaped rim 30 of an insulating material which is somewhat more resistant mechanically and also highly resistant to heat, for example of ceramic fibers or vermiculites, which is slightly upswept from the outer edge 26 of the dish and contacts by its surface the underside of a vitrified ceramic plate 29 forming the cooking point. This rim 30 then also serves simultaneously to safeguard the thermally insulating molding in the carrier dish and prevents lifting-off for instance during transit. Due to the large-surface hold-down and the fact that this rim 30 engages directly above the supporting shoulder 25 the thermally insulating molding 11 is subjected only to slight pressure forces when the radiant heater 11 is pliantly pressed into place to the underside of the vitrified ceramic plate. In diameter, i.e. in the horizontal dimensions the separate thermally insulating molding 25 may be somewhat smaller than the carrier dish so that also swelling due to heat, moisture or the like does not result in a tautening of the thermally insulating molding.

The resulting radiant heater thus features a top surface for carrying the heating conductors which is flat and has a uniform depth of embedding of the heating conductors, independent of the shape of the carrier dish, the bottom 24 of which may be curved fully intentionally or incidentally to counteract any trampoline effects during heating. Due to the single layer of highly thermal insulating and high-temperature resistant material the insulation is produced highly effective at moderate cost. Due to the low mechanical requirements there is practically no need for strengthening by including fibers.

The top surface 18 of the separate thermally insulating molding 15 is flat in the sense that it corresponds to the desired shape precisely. This surface could for instance consist of two levels offset with respect to each other in height when e.g. heating conductors of differing height are used in differing portions. Preferred however is the flat configuration of the top surface 18 oriented parallel to the underside of the vitrified ceramic as precisely as possible, in this case the top edges of the heating conductors being located in a plane oriented parallel to the vitrified ceramic surface.

We claim:

1. A method for producing a radiant heater, comprising the steps of:

forming a carrier dish having a generally flat-shaped bottom;

compressing a dry, loose, bulk-flowable, thermally-insulating material in a mold to form a tablet, said tablet having substantially flat-shaped top and bottom surfaces;

partially embedding a heating conductor in said tablet through said top surface to secure said heating conductor to said tablet; and inserting said tablet in said carrier dish, such that the bottom surface of said tablet and the bottom of said carrier dish are slightly separated to form an air gap therebetween.

2. The method as set forth in claim 1, wherein the portion of said heating conductor embedded in said tablet comprises protruding fastening feet.

3. The method as set forth in claim 1, further comprising the step of inserting said heating conductor in an insertion fixture, prior to the step of partially embedding.

4. The method as set forth in claim 1, wherein said tablet comprises a single layer.

5. The method as set forth in claim 1, wherein said tablet consists of compressed pyrogenic silicic acid aerogel.

6. A radiant heater, comprising:

a carrier dish having a bottom;

a thermally-insulating tablet pressed from a dry, bulk-flowable material, said tablet having a generally flat-shaped bottom surface and a substantially flat-shaped top surface; and a heating conductor having a top edge, said heating conductor secured to the top surface of said tablet, at least a portion of the bottom surface of said tablet resting upon the bottom of said carrier dish such that a gap is formed between at least a portion of the tablet bottom surface and the carrier dish bottom.

7. A radiant heater as set forth in claim 6, further comprising a carrier dish edge portion, at least a portion of said tablet resting directly on said edge portion.

8. The radiant heater as set forth in claim 7, wherein said carrier dish edge portion further comprises a supporting shoulder which is raised with respect to said carrier dish bottom, said tablet at least partially supported by said shoulder.

9. The radiant heater as set forth in claim 6, wherein said heating conductor is a thin, corrugated strip of metallic resistive material standing upright on said top surface of said tablet, said heating conductor comprising fastening feet curved to conform with the corrugation and protruding downwards, said fastening feet embedded in said thermally insulating tablet.

10. The radiant heater as set forth in claim 6, wherein said top surface of said tablet lies in a first plane and the top edge of said heating conductor lies in a second plane.

11. The radiant heater as set forth in claim 10, said first and second planes are parallel to each other.

12. A radiant heater, comprising:

a carrier dish having a bottom and a peripheral edge portion;

a thermally insulating tablet pressed from a dry, bulk-flowable material, said tablet inserted within said carrier dish and supported by said peripheral edge portion such that said tablet is positioned above the bottom of said carrier dish; and a heating conductor secured to said thermally insulating tablet.

13. The radiant heater as set forth in claim 12, further comprising a gap between the bottom surface of the tablet and the bottom of the carrier dish.

* * * * *